US007360607B2

(12) United States Patent
Aeberhard

(10) Patent No.: US 7,360,607 B2
(45) Date of Patent: Apr. 22, 2008

(54) HAND-HELD POWER TOOL WITH A TORQUE-LIMITING UNIT

(75) Inventor: Bruno Aeberhard, Studen (CH)

(73) Assignee: Robert Bosch GmbH, Stuttgart (DE)

( * ) Notice: Subject to any disclaimer, the term of this patent is extended or adjusted under 35 U.S.C. 154(b) by 29 days.

(21) Appl. No.: 11/285,829

(22) Filed: Nov. 23, 2005

(65) Prior Publication Data

US 2006/0118317 A1 Jun. 8, 2006

(30) Foreign Application Priority Data

Dec. 7, 2004 (DE) ..... 10 2004 058 808

(51) Int. Cl.
*B25B 21/00* (2006.01)

(52) U.S. Cl. ..... 173/176; 173/48; 173/178; 173/217

(58) Field of Classification Search ..... 173/178, 173/216, 128, 217, 176, 146, 48, 205; 192/56.1, 192/69.81; 475/265, 290
See application file for complete search history.

(56) References Cited

U.S. PATENT DOCUMENTS 2,797,564 A * 7/1957 Bonneau et al. ..... 464/38
4,606,443 A * 8/1986 Kimura ..... 475/263
4,678,452 A * 7/1987 Nelson et al. ..... 464/38
4,869,131 A * 9/1989 Ohmori ..... 475/266
5,550,416 A * 8/1996 Fanchang et al. ..... 310/83
5,897,454 A * 4/1999 Cannaliato ..... 475/265
6,010,426 A * 1/2000 Nakamura ..... 477/22
6,142,242 A * 11/2000 Okumura et al. ..... 173/48
6,142,243 A * 11/2000 Mayer ..... 173/176
6,502,648 B2 * 1/2003 Milbourne ..... 173/178
6,926,095 B2 * 8/2005 Chen ..... 173/48
6,983,810 B2 * 1/2006 Hara et al. ..... 173/176
2003/0143042 A1 7/2003 Doyle et al.

FOREIGN PATENT DOCUMENTS

| | | |
|---|---|---|
| DE | 33 42 880 | 6/1985 |
| DE | 103 09 057 | 9/2004 |
| FR | 2 839 272 | 11/2003 |
| GB | 2 334 909 | 9/1999 |

* cited by examiner

*Primary Examiner*—Scott A. Smith
(74) *Attorney, Agent, or Firm*—Michael J. Striker

(57) ABSTRACT

A hand-held power tool has a motor output shaft, a tool driver, a torque-limiting unit with which a maximum torque transferred from the motor output shaft to the tool driver is adjustable by an operator; an actuating element that adjusts the torque-limiting unit, and a retaining element with a spring element, wherein the retaining element holds the adjusting element in a position set by the operator, and a spring element exerts a retaining force directed in an axial direction of the tool driver.

9 Claims, 4 Drawing Sheets

HAND-HELD POWER TOOL WITH A TORQUE-LIMITING UNIT

CROSS-REFERENCE

The invention described and claimed hereinbelow is also described in DE 10 2004 058 808.2, filed Dec. 7, 2004. This German Patent Application, whose subject matter is incorporated here by reference, provides the basis for a claim of priority of invention under 35 U.S.C. 119 (a)-(d).

BACKGROUND OF THE INVENTION

The present invention is directed to a hand-held power tool with a torque-limiting unit.

Hand-held power tools, such as cordless screwdrivers, cordless drills or cordless impact drills have a high amount of drive torque. Limiting this torque is desirable for many applications. Adjustable torque limitation makes it possible, e.g., to screw a number of screws into a work piece with the same level of screw-down torque; a torque-limiting unit disengages as soon as the screws apply a certain level of torque resistance to the motor output shaft. The operator can adjust the torque-limiting unit according to the maximum torque required for the task at hand.

Publication DE 103 09 057 A1 makes known a hand-held power tool with adjustable torque limitation with which an operator adjusts—using an actuating means—the maximum torque to be transferred from a motor output shaft to a tool driver. If the torque produced by the motor exceeds a maximum torque level that was set, an overload clutch disengages and the connection between the motor output shaft and the tool driver is separated. The actuating means, which are capable of being grasped by an operator, are retained by a retaining element in the position set by the operator, the retaining element including a notched ring with radially outwardly directed notches and an external plate spring. The plate spring engages from the radially outward direction into the notches of the retaining element and retains it in the desired position.

SUMMARY OF THE INVENTION

The present invention is directed to a hand-held power tool with a torque-limiting unit with which a maximum torque is transferred from a motor output shaft to a tool driver and that is adjustable by an operator, an adjusting means that adjusts the torque limiting unit and a retaining element with a spring element, the retaining element holding the adjusting means in a position set by the operator.

It is provided that the spring element exerts a retaining force directed in an axial direction of the tool driver. Installation space in the radial direction can be spared, and the hand-held power tool can be kept compact, which is of particular advantage with hand-held power tools powered by rechargeable batteries, these hand-held power tools typically being very compact in design. The axial direction of the tool driver refers to the axis of rotation of the tool driver.

The compactness of the hand-held power tool can be increased even further when the spring element is a coiled spring.

Compared to a plate spring, the coiled spring also has the advantage that it shows signs of mechanical wear less rapidly than a plate spring. In addition, a coiled spring can be situated such that it can be installed easily and automatically, which is very difficult to realize with a plate spring.

A high level of comfort with the hand-held power tool can be achieved when the retaining force is independent of a setting of the adjusting means. The adjusting means can always counteract the same force by an operator during adjustment of the adjusting means, independently of the maximum torque set at that instant, so that a comfortable and error-free adjustment of the maximum torque is attainable. In addition, the retaining element can be designed with few individual parts, while decoupling the retaining force from an adjustment of an adjusting means, thereby keeping installation of the hand-held power tool simple.

In a further embodiment of the present invention, the retaining element include a position element that assigns discrete adjustment positions and a detent element that snaps into the position element and retains the spring element. The adjusting means can be retained in the set position using particularly few, easily installed components via a snap-in configuration. In addition, a noise can be produced by the snap-in procedure that signals to the operator that the adjusting means have been set. The detent element is movable relative to the adjusting means in particular and can be composed of a bolt that advantageously has a rounded and, in particular, hemispherical head.

A particularly simple installation of the hand-held power tool combined with few movable elements can be attained when the detent element retains the position element in its working position in the axial direction. An additional fastening of the position element in the axial direction is therefore not necessary.

A stable support of the detent element combined with an easy axial sliding behavior of the detent element can be attained when the detent element extends axially and is supported within a front third of its axial length in the radial direction that points toward the position element. A transverse force acting on the detent element when the position element is rotated can be absorbed without the detent element tilting in its support. In addition, the tendency of the detent element to tilt when the adjusting means are actuated can be compensated for.

Advantageously, the detent element is also supported at a second point outside of the front third. As a result, a tendency of the detent element to tilt when the adjusting means are actuated can be kept minimal. The second support is advantageously positioned in the rear half, and in particular in the rear one-third of the detent element in terms of its axial length.

In a further advantageous embodiment of the present invention, the detent element is supported in an opening that accommodates the entire spring element. The spring element can be protected from contamination and supported along its entire axial length.

By way of a stepped configuration of the radial diameter of the opening, the detent element can be supported with its rear end in a radially narrower region of the opening and simultaneously supported with its radially wider front part in the radially wider front part of the opening. A particular stable support of the detent element is attained.

It is also provided that the adjusting means include an actuating means capable of being grasped by the operator, and the retaining element includes a position element that is connected with the actuating means in a form-fit manner, that is detachable from the actuating means and assigns discrete adjustment positions. Due to the fact that the position element is detachable from the actuating means, different position elements can be used for different machine types of the hand-held power tool, each with the same actuating means, by way of which an economical manufacture of different series is made possible. The form fit between the position element and the actuating means can be attained in a particularly simple manner using grooves in the adjusting means, in particular in the actuating means, into which the position element is inserted in the axial direction. With discrete adjustment positions, an unintended displacement of the actuating means can be counteracted.

A particularly simple and economical manufacture of the position element can be attained when the position element is disc-shaped.

In addition, the discrete adjustment positions are advantageously formed by a number of position elements in the form of holes in the position element. The position element can be kept axially narrow, and the hand-held power tool can be kept compact. In addition, holes are particularly easy to manufacture and are good snap-in points into which the detent element can engage. To enable easy actuation of the adjusting means, the holes are advantageously chamfered.

Instead of holes, the discrete adjustment positions can be formed by a wavy position element. The position element is advantageously disc-shaped and can be manufactured in a particularly economical manner, e.g., by deep drawing.

A position element that is narrow particularly in the radial direction and a resultant compact design of the hand-held power tool can be attained when the discrete adjustment positions are formed by teeth on the position element rather than by holes. The position element can be configured in the shape of a crown wheel, e.g., a bevel gear with a bevel angle of 180°, the teeth of which form recesses in the axial direction into which the detent element can engage. A cylindrical position element formed out of sheet metal is also feasible; it enables a radially particularly compact design. Independently of the type of elements that form the adjustment positions, they are advantageously located on the position element in a circular pattern.

Simple installation of the hand-held power tool can be attained when the adjusting element includes an actuating element capable of being grasped by the operator, and the retaining element includes a position element that is connected with the actuating element in a bonded manner, that is detachable from the actuating element and assigns discrete adjustment positions. The position element can comprise a coating applied by injection moulding or casting that is the plastic out of which the actuating element is made, or it can be bonded with the actuating element.

In an alternative embodiment, position elements that assign discrete adjustment positions are formed directly in the actuating element, e.g., as holes or a wave shape.

A particularly fine adjustability of the maximum torque can be attained when the retaining element includes a position element that assigns discrete adjustment positions formed by a number of position elements located uniformly around a circular arc larger than 180°.

With the same advantage, the retaining element includes a position element that assigns discrete adjustment positions and also includes, at the most, a single detent element that engages in the adjustment positions.

The novel features which are considered as characteristic for the present invention are set forth in particular in the appended claims. the invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
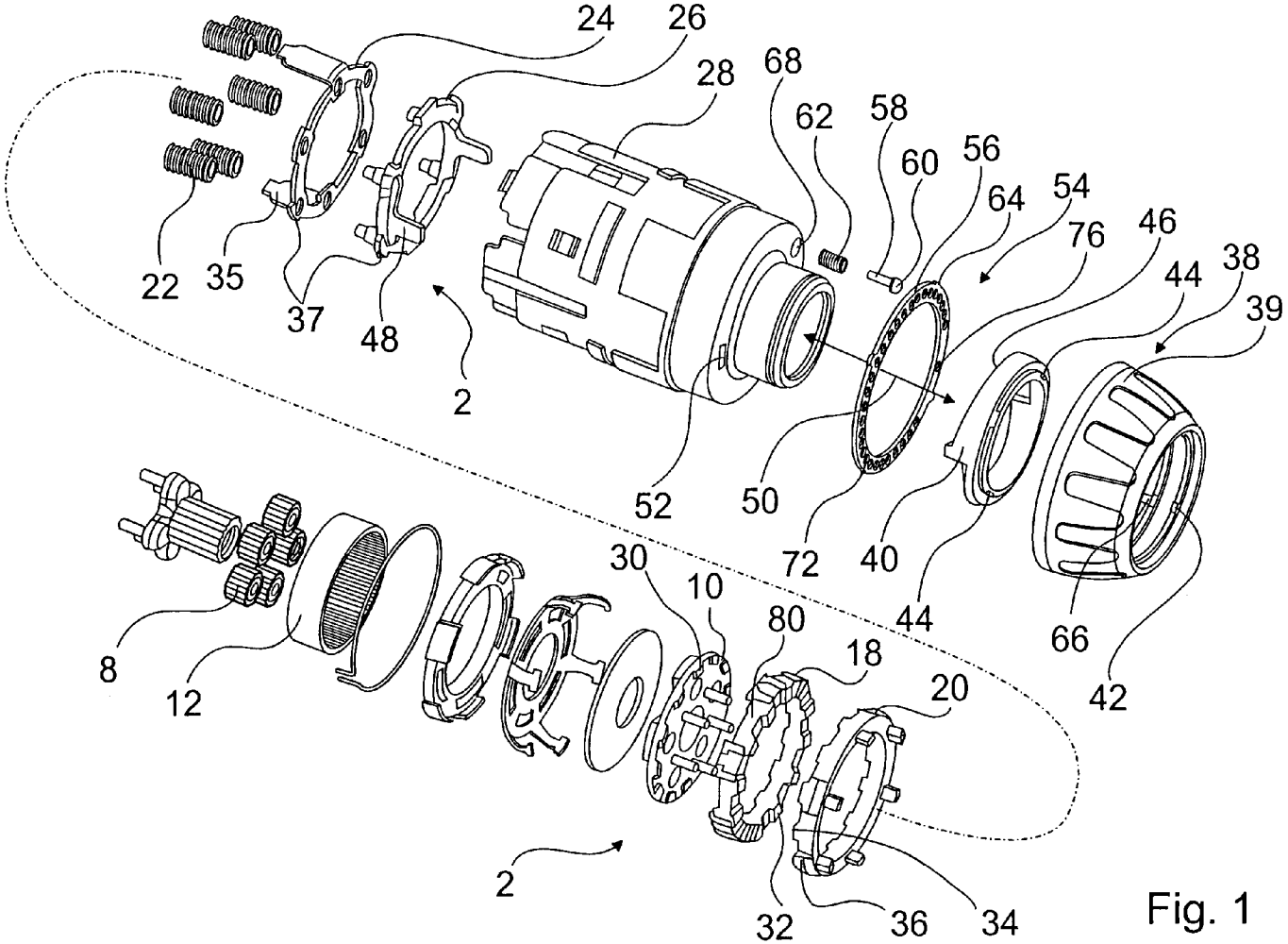
FIG. 1 Shows a front part of a cordless screwdriver in an exploded view.
Figure 2:
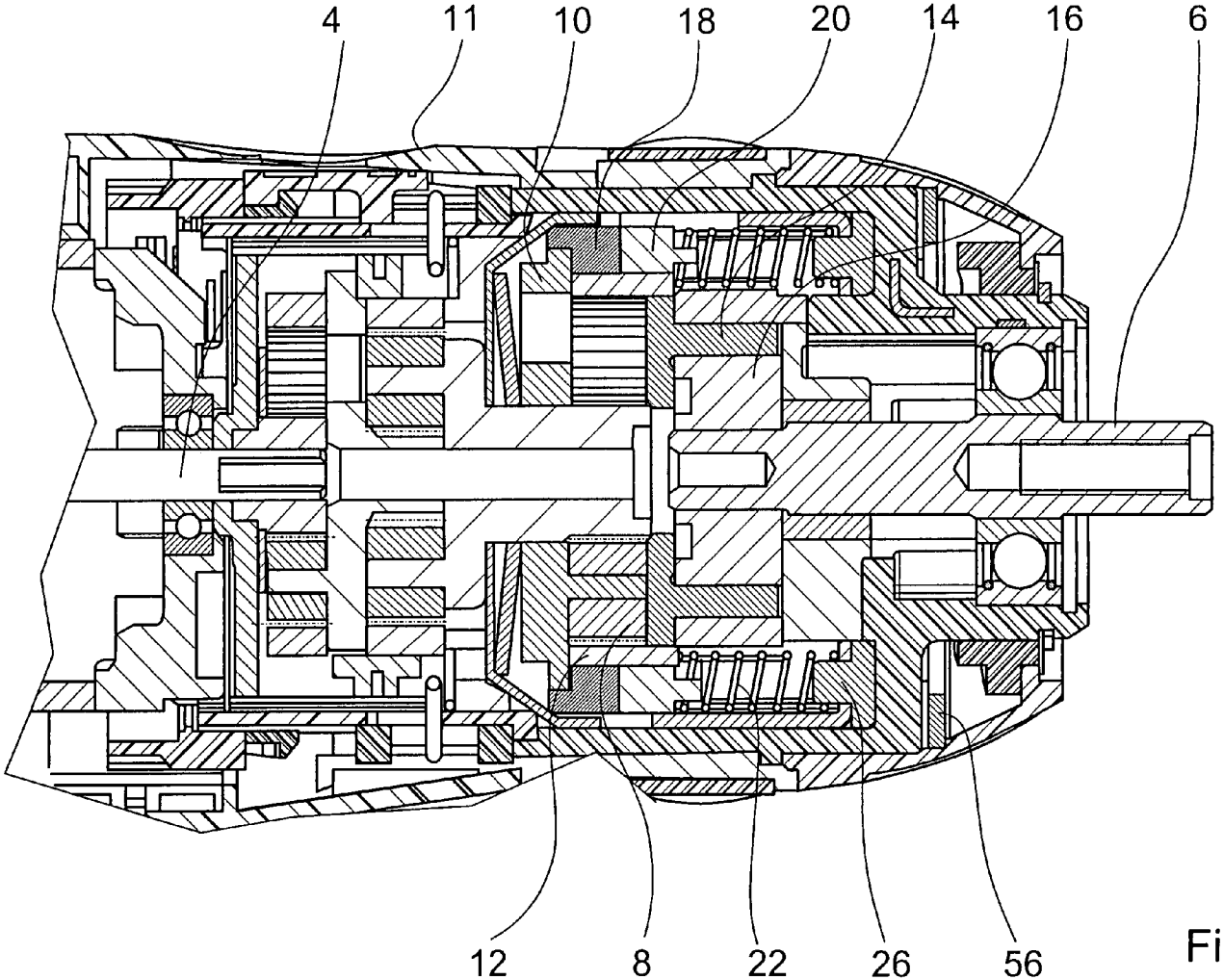
FIG. 2 Shows the front part of the cordless screwdriver in FIG. 1 in a sectional view, FIG. 3 Shows a section of FIG. 2 with a position element and a detent element, FIG. 4 Shows the detent element in FIG. 3 in a position in which it is engaged in the position element, FIG. 5 Shows an alternative position element, FIG. 6 Shows the position element in FIG. 5 in a sectional illustration, FIG. 7 Shows a further position element, and FIG. 8 Shows the position element in FIG. 7 in a sectional illustration.

FIGS. 1 and 2 show a front part of a hand-held power tool designed as a cordless screwdriver, in an exploded view (FIG. 1) and a sectional illustration (FIG. 2). The hand-held power tool includes a torque-limiting unit 2, a motor output shaft 4, and a tool driver 6. To drive tool driver 6, torque from motor output shaft 4 is transferred to three-stage planetary gearing that includes planet gears 8 that therefore rotate on their axes. Planet gears 8 are supported on a planet carrier 10 that, in the normal working mode, does not also rotate, i.e., it is fixed and does not also rotate in a normal working mode, i.e., it is fixedly connected with a housing 11 of the hand-held power tool. Planet gears 8 drive an internal gear 12, the inner toothing of which encompasses a driving element 14 and drives it. Driving element 14 drives a star wheel 16, and star wheel 16 drives tool driver 6 via a square socket.

In normal operation, planet carrier 10 is stationary relative to housing 11. It is non-rotatably connected with a guide sleeve 28 via two locking discs 18, 20, six coiled springs 22 and two thrust members 24, 26, with guide sleeve 28, in turn, being fastened to the housing of the hand-held power tool. The non-rotatable connection is created by cams 30 on planet carrier 10 that engage with cams on first locking disc 18, first locking disc 18 with cams 32 being connected with second locking disc 20 via cams 34 on second locking disc 20. Second locking disc 20 is retained by arms 35 of thrust member 24, arms 35 extending between two raised areas of second locking disc 20. The two thrust members 24, 26 are retained via recesses 37 in inner grooves (FIG. 3) of guide sleeve 28.

When tool driver 6 is blocked during operation of the hand-held power tool, e.g., if one of the drill bits retained by tool driver 6 tilts, the internal gear is held in place by star wheel 16 and driving element 14. The torque of motor output shaft 6, having been stepped up by planet gears 8, is now transferred to planet carrier 10. The planet carrier is now retained on first locking disc 18 by its cams 30. If the torque acting on planet carrier 10 exceeds a value set by an operator with the aid of an adjusting element 38, second locking disc 20 is deflected against coiled springs 22, and first locking disc 18 can rotate against second locking disc 20 along with planet carrier 10. Locking discs 18, 20 rotate in opposing directions in a ratcheting manner.

To adjust a maximum torque to be transferred to tool driver 6, above which the two locking discs 18, 20 rotate in opposing directions in a ratcheting manner, the spring pressure of coiled springs 22 applied to second locking disc 20 can be varied with the aid of adjusting element 38.

To this end, adjusting element 38 includes an actuating element 39 into which a cam ring 40 is inserted, recesses 42 of actuating element 39 engaging in recesses 44 of cam ring 40 and connecting it in the circumferential direction in a form-fit manner with actuating element 39. When actuating element 39 is rotated, cam ring 40 also rotates, arms 48 sliding on a cam track 46 of cam ring 40, which causes thrust member 26 to move in axial direction 50. Arms 48 extend through recesses 52 in guide sleeve 28 and, loaded by the spring force of coiled springs 22, are pressed against cam track 46. When thrust member 26 moves in axial direction 50, the spring pressure of coiled spring 22 with which second locking disc 20 is pressed against first locking disc 18 varies, thereby varying the limit torque and/or maximum torque above which second locking disc 20 moves over first locking disc 18 in a ratcheting manner.

To prevent unintended displacement of actuating element 39 during operation of the hand-held power tool, the hand-held power tool includes a retaining element 54 that includes a position element 56 in the form of a perforated disc, a detent element 58 in the form of a bolt with a rounded-off head 60, and a spring element 62 in the form of a coiled spring. Position element 56 is supported in grooves 66 of actuating element 39 with the aid of four cams 64 and is therefore fastened to actuating element 39 in a form-fit manner in the circumferential direction.

Figure 3:
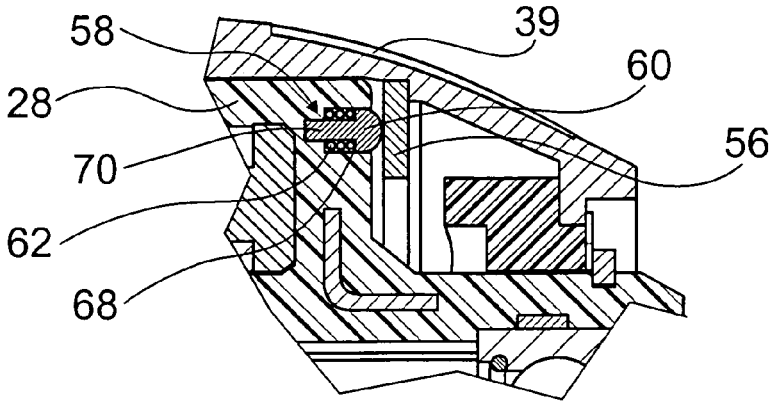
Figure 4:
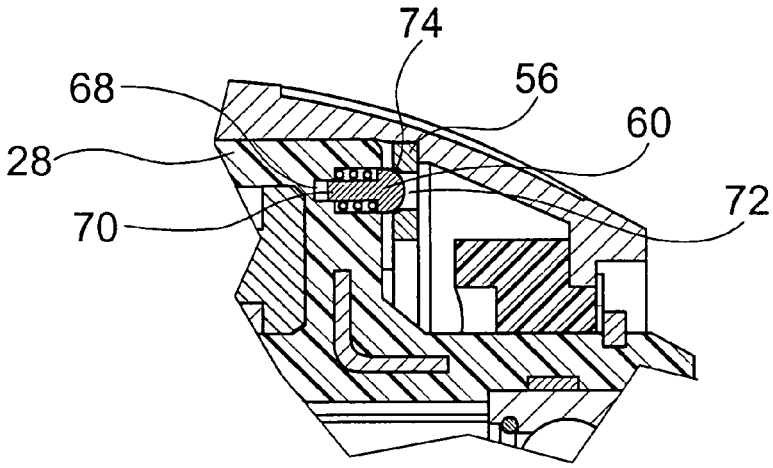

The support of detent element 58 is shown in FIGS. 3 and 4, in which a section from FIG. 2 is shown. Detent element 58 is inserted in a stepped opening 68 of guide sleeve 28. In its rear—i.e., pointing away from a tool in tool driver 6—third, opening 68 has a smaller radial diameter than in its front third. A shank 70 of detent element 58 is inserted into the rear, narrow part of opening 68 and is supported with a clearance fit in opening 68 such that it is displaceable in the axial direction. Head 60 of detent element 58, which has a cylindrical configuration at least in its rear one-fourth, is supported with a clearance fit in the anterior, wider part of opening 68 such that it is displaceable in axial direction 50. In this manner, detent element 58 is stably supported against tilting in detent element 58 at two points in opening 68, the points being separated from each other in axial direction 50.

In the position of detent element 58 shown in FIG. 3, spring element 62—which is located in entirety in the wide part of opening 68—is compressed and presses spherical head 60 between two position elements 72 configured as holes against position element 56. When position element 56 is rotated when an operator rotates actuating element 39, one of the holes and/or position elements 72 rotates in front of head 60. Head 60 can snap into position element 72, as shown in FIG. 4. The rear end of shank 70 remains in the rear part of opening 68 with the narrow cross section and remains supported there. In addition, the cylindrical part of head 60 remains in the front part of opening 68 with the larger diameter and is also permanently supported there, so that detent element 58 is also supported in two positions in the position shown in FIG. 4, and is secured against tilting. When position element 56 is rotated further, head 60 is pressed out of the holes and/or position elements 72 via chamfers 74 on the holes, and are pressed into opening 68. Perforated ring and/or position element 56 can now be rotated further, until head 60 snaps into an adjacent hole.

Position element 56 includes a larger number of position elements 72 located on position element 56 in a circular pattern such that they extend around an angle of 300°. A further position element 76 located at a distance from other position elements 72 is located on position element 56, which marks a drilling point, in which neither locking disc 18, 20 slips and the maximum torque is no longer set by torque-limiting unit 2. In this position, arms 48 of thrust member 26 are pressed by cam ring 40 to a maximum distance from a tool, thrust member 26 pressing thrust member 24 and locking disc 20 into a maximum displacement in the direction of first locking disc 18 and preventing locking disc 20 from moving axially and locking disc 18 from slipping. Arms 35 of first thrust member 24 extend into radial recesses 80 of first locking disc 18, by way of which it is non-rotatably connected with guide sleeve 28.

Figure 5:
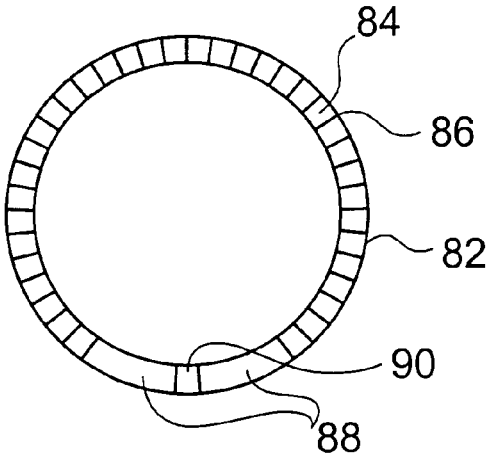
Figure 6:
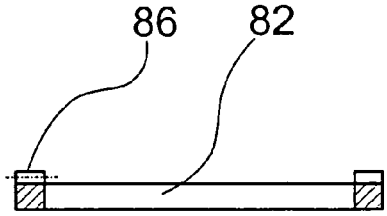

FIGS. 5 and 6 show a further position element 82 in the form of a crown gear, in a top view and a sectional illustration. Discrete adjustment positions into which head 60 can engage form position elements 84 in the form of valleys between radially oriented teeth 86 of the gear. A single position element 90 in the form of a valley is located between two regions 88 configured as a longitudinal peak, the valley serving as the detent position of detent element 58 in a drilling position in which the two locking discs 18, 20 do not ratchet over each other.

Figure 7:
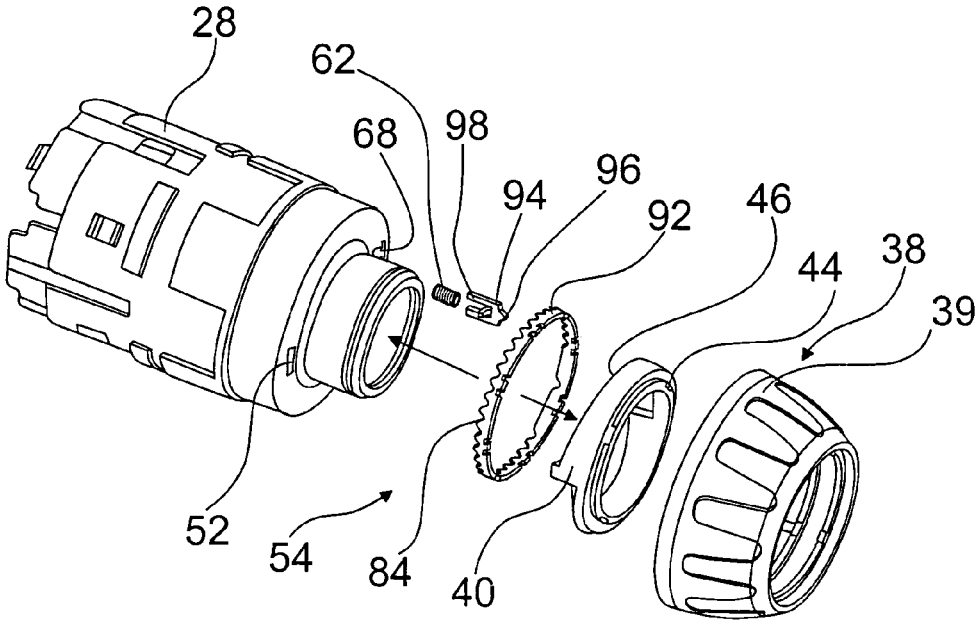
Figure 8:
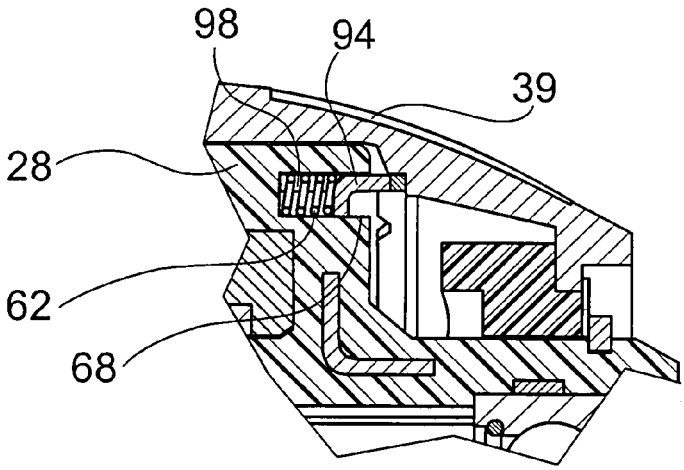

An alternative position element 92 is shown in FIGS. 7 and 8 that is composed of a tubular piece of sheet metal, encompasses cam ring 40 and can either be inserted into actuating element 39 or bonded therewith via adhesion or as a coating applied by injection moulding. A shaped piece of sheet metal is also used as detent element 94, which engages via a projection 96 into position elements 84 configured as recesses and encompasses spring element 62 with two arms 98. Detent element 94 is supported in the opening by arms 98 along 80% of its axial length.

It will be understood that each of the elements described above, or two or more together, may also find a useful application in other types of constructions differing from the types described above.

While the invention has been illustrated and described as embodied in a hand-held power tool with a torque-limiting unit, it is not intended to be limited to the details shown, since various modifications and structural changes may be made without departing in any way from the spirit of the present invention.

Without further analysisreveal the foregoing will so fully reveal the gist of the present invention that others can, by applying current knowledge, readily adapt it for various applications without omitting features that, from the standpoint of prior art, fairly constitute essential characteristics of the generic or specific aspects of the invention. What is claimed as new and desired to be protected by Letters Patent is set forth in the appended claims.

The invention claimed is:

1. A hand-held power tool, comprising a motor output shaft; a tool driver; a torque-limiting unit with which a maximum torque transferred from said motor output shaft to said tool driver is adjustable by an operator; an adjusting element that adjusts said torque-limiting unit; and a retaining element with a spring element, wherein said retaining element holds said adjusting element in a position set by the operator, and the spring element exerts a retaining force directed in an axial direction of said tool driver, wherein said adjusting element includes an actuating element graspable by the operator, while said retaining element includes a position element that is connectable with said actuating element in a form-fit manner, is detachable from said actuating element and assigns discrete adjustment positions, and wherein the position element is inserted in the actuating element in the axial direction.

2. A hand-held power tool as defined in claim 1, wherein said spring element is a coiled spring.

3. A hand-held power tool as defined in claim 1, wherein said spring element is configured so that the retaining force is independent of an adjustment of said adjusting element.

4. A hand-held power tool as defined in claim 1, wherein said retaining element includes a detent element that engages in said position element and retains said spring element.

5. A hand-held power tool as defined in claim 4, wherein said detent element has an axial length and is supported in a radial direction within a front third of its axial length that points toward said position element, such that a transverse force acting on the detent element is absorbed without the detent element tilting in its support.

6. A hand-held power tool as defined in claim 4, wherein said detent element is supported in an opening that accommodates an entire said spring element.

7. A hand-held power tool as defined in claim 1, wherein said position element is configured as a disk-shaped position element.

8. A hand-held power tool as defined in claim 1, wherein the position element is further connectable with said actuating element in a bonded manner.

9. A hand-held power tool as defined in claim 1, wherein said retaining element includes a position element that assigns discrete adjustment positions and is formed by a number of position elements located uniformly around a circular arc larger than 180°.

* * * * *